US005248536A

United States Patent [19]

Du Katz

[11] Patent Number: 5,248,536

[45] Date of Patent: Sep. 28, 1993

[54] APPARATUS FOR DISPLAYING REMOVABLE INDICIA

[75] Inventor: Eugene M. Du Katz, West Bend, Wis.

[73] Assignee: Serigraph Inc., West Bend, Wis.

[21] Appl. No.: 807,441

[22] Filed: Dec. 13, 1991

[51] Int. Cl.[5] ..... G09F 1/10

[52] U.S. Cl. ..... 428/40; 428/13; 428/41; 428/187; 428/194; 428/202; 428/203; 428/220; 428/354; 40/158.1; 40/159; 40/594; 40/615; 40/638; 40/661

[58] Field of Search ..... 428/40, 41, 13, 194, 428/202, 203, 220, 354, 187; 40/158.1, 159, 615, 594, 661, 638; D6/613-616

[56] References Cited

U.S. PATENT DOCUMENTS

| | | | |
|---|---|---|---|
| 2,936,540 | 5/1960 | Power | 40/158.1 |
| 3,241,857 | 3/1966 | Goetz | 280/154.5 |
| 3,515,262 | 6/1970 | Ornstein | 206/1 |
| 3,920,870 | 11/1975 | Ackerman | 428/46 |
| 4,079,881 | 3/1978 | Sabb | 40/158.1 |
| 4,083,137 | 4/1978 | Rozmanith | 40/158.1 |
| 4,263,734 | 4/1981 | Bradshaw | 40/324 |
| 4,510,006 | 4/1985 | Lawson | 428/40 |
| 4,557,517 | 12/1985 | Bolduc | 296/1 |
| 4,944,968 | 7/1990 | Wagner | 428/13 |
| 4,991,330 | 2/1991 | Heidari | 40/158.1 |
| 5,096,752 | 3/1992 | Wagner | 428/13 |

FOREIGN PATENT DOCUMENTS

| | | | |
|---|---|---|---|
| 12865 | 12/1956 | Fed. Rep. of Germany | 40/158.1 |

*Primary Examiner*—Ellis P. Robinson
*Assistant Examiner*—Nasser Ahmad
*Attorney, Agent, or Firm*—Godfrey & Kahn

[57] ABSTRACT

An apparatus for displaying removable indicia, the apparatus including a base sheet having an outwardly facing surface which is operable to support individual removable indicia; a substantially transparent cover sheet which is borne by the base sheet, and which is operable to substantially fix the indicia in a predetermined position thereon; and a zone of adhesive which is deposited in a predetermined pattern on one of the two sheets and which releasably affixes the base sheet and the transparent sheet together. During use, the transparent sheet is separated in spaced relation from the base sheet to permit the placement of the indicia in respective predetermined positions on the base sheet, after which, the transparent sheet is then pressed into adhesive engagement with the base sheet to releasably seal and fix the position of the indicia thereon.

3 Claims, 4 Drawing Sheets

APPARATUS FOR DISPLAYING REMOVABLE INDICIA

FIELD OF THE INVENTION

The present invention relates generally to an apparatus for displaying removable indicia, and more particularly, to an apparatus which is operable to selectively receive removable indicia for display on a variety of surfaces. The preferred embodiment of the apparatus of the present invention functions as a new and improved counter mat.

DESCRIPTION OF THE PRIOR ART

A prior art display means that has existed for decades, and which has been employed as a primary method of displaying indicia of all types is the printed poster. However, as technology has progressed in the fields of printing and the production of adhesives and assorted synthetic materials, this type of display means has been replaced by other display apparatuses that are significantly more complex in design, and which are considered more aesthetically appealing. Present in the modern marketplace are a multiplicity of different advertising display devices which have been developed in an attempt to meet the demands created by commerce, that is, to rapidly and succinctly convey to potential consumers relevant product and service information.

Heretofore, these prior art display apparatuses have generally included four categories of design. In the first design category, these prior art display devices typically have included a frame member and a translucent cover member which, when assembled, are operable to protect and mount advertising indicia on a suitable supporting surface, e.g., an interior building wall in a respective business establishment, for example. In the second design category, prior art display apparatuses typically have included laminated assemblies which permanently and sealingly enclose advertising indicia, and which, display the relevant product information to a consumer when mounted on any suitable supporting surface. In the third design category, prior art advertising display apparatuses have included a backlighted, substantially translucent base material which has deposited thereon substantially opaque printed materials. Finally, and in the fourth design category, prior art advertising display apparatuses have included a substantially translucent pocket which is operable to receive suitable indicia for viewing by the consumer. While these prior art devices have operated with some degree of success, they are each replete with a multiplicity of deficiencies and shortcomings which have detracted from their usefulness.

Foremost among the deficiencies of the prior art display apparatuses of the first design category is their apparent inability to be easily moved from one supporting surface to another. Typically in a commercial environment, display apparatuses of this first design category are semi-permanently mounted on a supporting surface by means of screws or other similar fasteners. Therefore, and when a proprietor desires to change the commercial appearance of his or her establishment, removal and subsequent replacement of the display apparatuses generally requires substantial effort.

Another deficiency of the prior art display apparatuses of the first design category is that such apparatuses generally do not function well in a commercial environment when such devices are mounted on a substantially horizontal counter surface. More particularly, and when mounted on a counter surface, this type of device extends substantially upwardly relative to the substantially planar counter surface on which it is mounted thereby trapping debris and other miscellaneous particles of matter at the interface of the display apparatus and the counter surface. For example, and in a fast-food restaurant, when this type of display apparatus is employed and is positioned next to a cash register to advertise the special meal of the day for example, particles of food and debris frequently becomes lodged between the frame member and the counter surface thereby creating an unsanitary, and unsatisfactory condition.

Another deficiency of the prior art display apparatuses of the second design category is that these same display apparatuses do not accommodate the selective introduction or removal of advertising indicia. For example, in a typical commercial environment wherein a business is subject to rapidly changing consumer demands, advertising campaigns are frequently launched to introduce new products or services. Also, new advertising campaigns must often be initiated when the business owner desires to alter the relevant description of existing products and services. Therefore, display apparatuses of this second design type, which permanently and sealingly enclose advertising indicia, are frequently rendered valueless when commercial advertising campaigns are altered in any significant fashion. An example of a display apparatus of this second design type is disclosed in U.S. Pat. No. 4,510,006.

Yet another deficiency of the prior art display apparatuses of the third design category is that the printed matter which is deposited on the substantially translucent substrate usually cannot be altered. An example of a display apparatus of this third category is disclosed in U.S. Pat. No. 4,557,517.

Yet another deficiency common to all of the prior art display apparatuses is their apparent inability to display regional price fluctuations or product information to potential consumers. More particularly, and in a business franchise, substantially similar advertising campaigns are typically initiated by regional franchisees at identical points in time. Typically, the materials to support such advertising campaigns are supplied by the franchisor. In view of this shortcoming, franchisor's heretofore, have by necessity, produced a multiplicity of different display devices to reflect the regional price differentiations and assorted product descriptions. This, of course, is time consuming, and quite expensive, in some instances.

Yet another deficiency attendant with all of the prior art display assemblies is their apparent inflexibility to exhibit daily changing product pricing and product information in a fashion which does not readily appear as though it was recently altered. Such flexibility would, of course, permit a merchant to more efficiently utilize these often costly display apparatuses.

Therefore, it has long been known that it would be desirable to have an apparatus for selectively displaying removable indicia, and which is particularly well suited to exhibit changing product information, and which is operable to permit the user thereof to easily remove and replace the indicia from the display apparatus, and wherein the apparatus would be light weight, inexpensive to manufacture, and which would also be adapted to be mounted on a plurality of supporting surfaces for viewing by potential consumers.

SUMMARY OF THE INVENTION

Therefore, it is an object of the present invention to provide an improved apparatus for displaying removable indicia.

Another object of the present invention is to provide such an apparatus which is operable to obtain the individual benefits to be derived from related prior art devices and practices while avoiding the detriments individually associated therewith.

Another object of the present invention is to provide such an apparatus which is operable to selectively receive and enclose removable indicia thereby sheltering or otherwise substantially protecting the indicia from environmental influences which could act upon same.

Another object of the present invention is to provide such an apparatus which is lightweight and multi-functional in design such that it may be mounted on a counter of a commercial establishment, or similar working surfaces.

Another object of the present invention is to provide such an apparatus which is of relatively nominal cost to purchase and maintain.

Another object of the present invention is to provide such an apparatus which permits the selective introduction or removal of a plurality of different advertising or product information indicia to accommodate such commercial activities as, modified advertising campaigns, new products or services, and daily or regional price fluctuations.

Another object of the present invention is to provide such an apparatus which is characterized by simplicity of construction.

Another object of the present invention is to provide such an apparatus which is operable to exhibit a plurality of different advertising or product information indicia in a fashion which, when viewed by a consumer, does not readily appear to have been altered.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for displaying removable indicia, the apparatus having a base sheet having a predetermined shape which is defined by a peripheral edge, the base sheet including an outwardly facing display surface and an opposite inwardly facing surface, the outwardly facing display surface being operable to support the removable indicia; a substantially transparent sheet borne by the base sheet, and which is operable to substantially fix the indicia in a predetermined location on the base sheet; and a zone of adhesive which is deposited in a predetermined pattern on one of the two sheets and which releasably fixes the base sheet and transparent sheets together, the transparent sheet operable to be separated in spaced relation from the base sheet thereby permitting placement of the indicia in the predetermined location, and wherein the transparent sheet is then pressed into engagement with the base sheet thereby substantially sealing and fixing the position of the indicia within the apparatus.

DETAILED DESCRIPTION OF THE PREFERRED EMBODIMENT

FIRST FORM

Figures 1, 2:
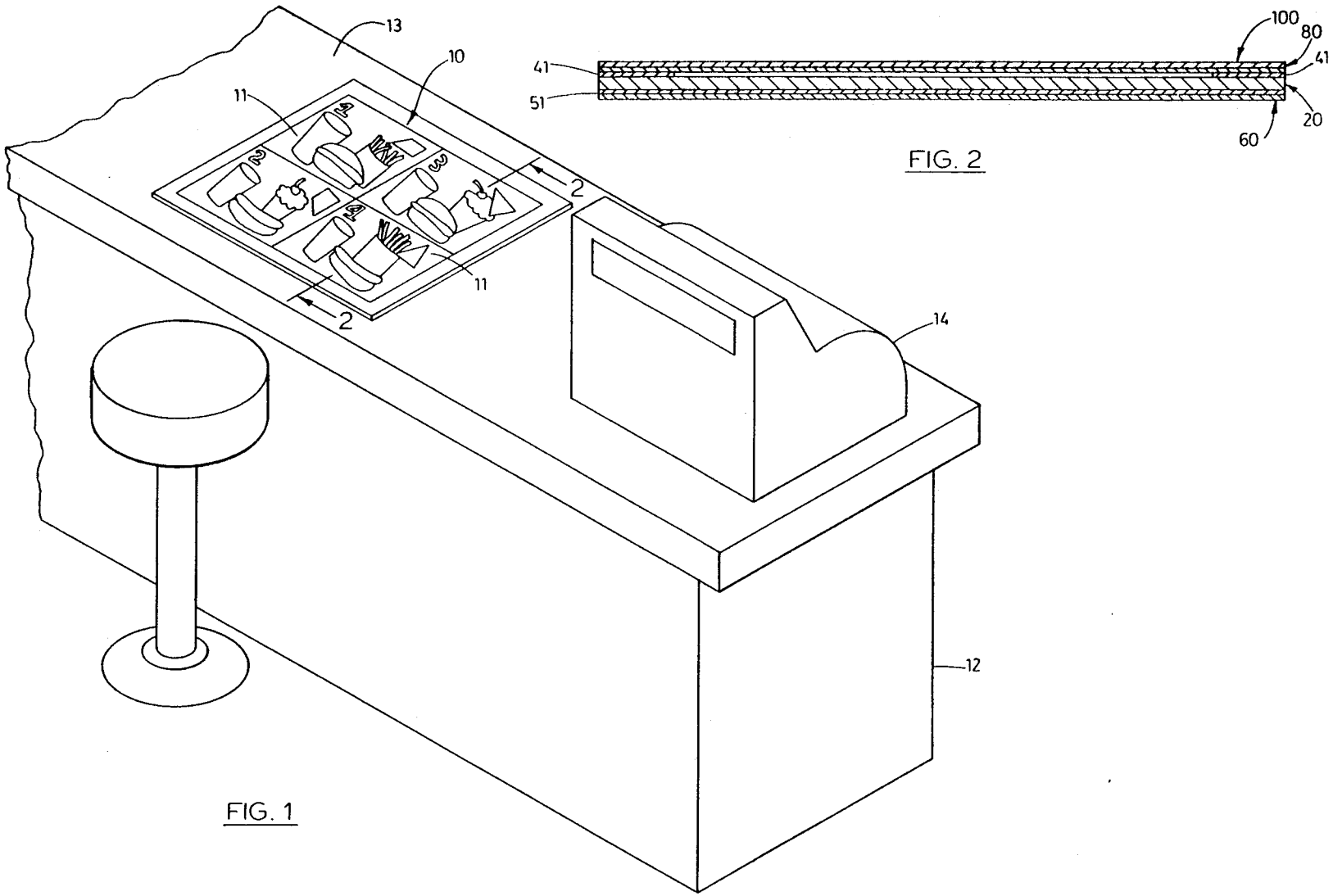
FIG. 1 is a perspective, environmental view of the first form of the apparatus of the subject invention shown in a typical operative configuration wherein it is mounted on a serving counter in a restaurant or similar business.
FIG. 2 is a transverse, vertical, sectional view of the first form of the apparatus of the subject invention, and which is taken from a position along line 2—2 of FIG. 1.
Figure 4:
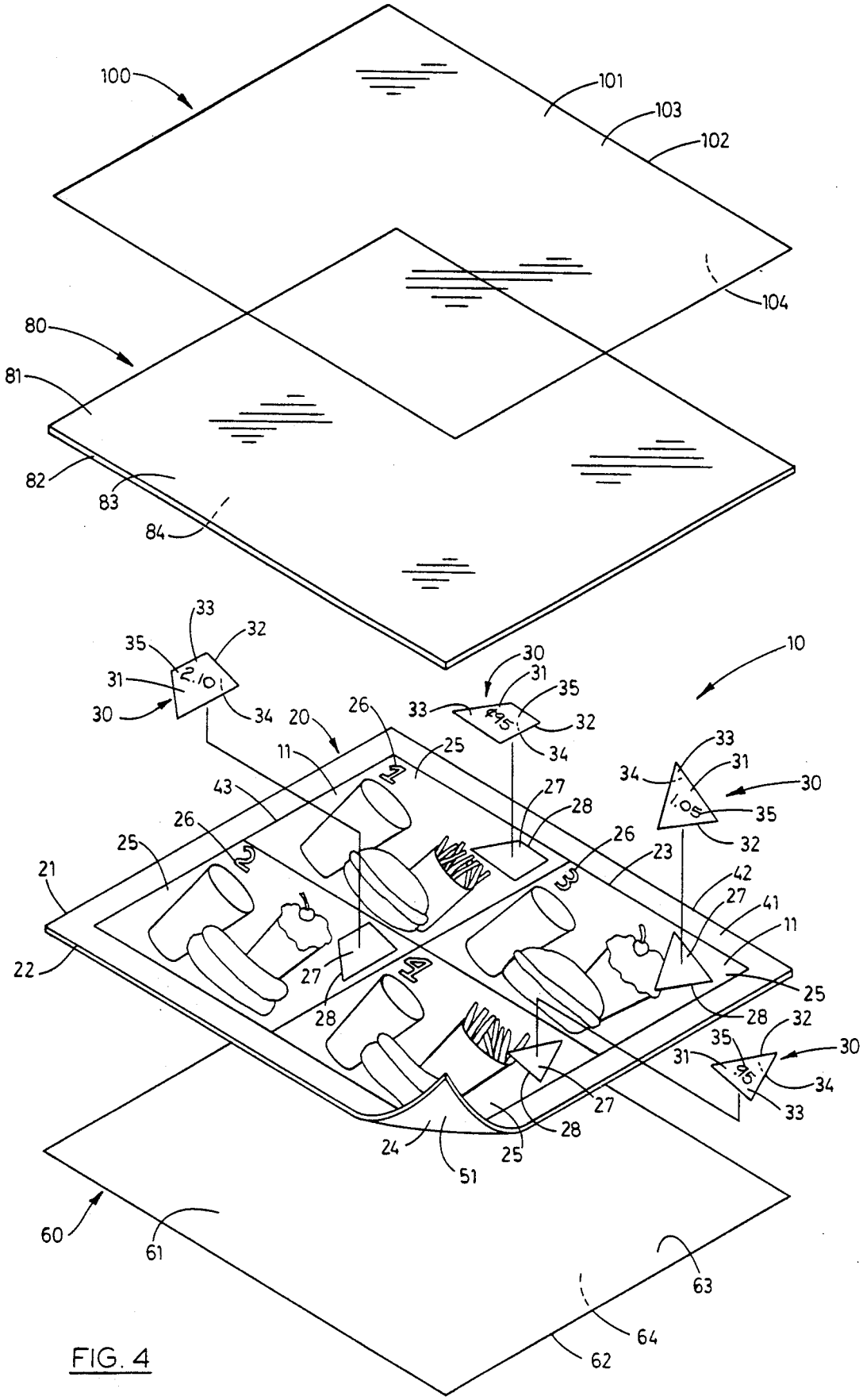
FIG. 4 is a perspective, exploded view of the first form of the apparatus of the subject invention.

Referring more particularly to the drawings, the apparatus of the subject invention is generally indicated by the numeral 10 in FIGS. 1 and 4. As illustrated therein, the apparatus 10 functions as a new and improved counter mat which is operable to display printed advertising indicia 11. As best understood by a study of FIG. 1, the apparatus 10 is surmounted on a counter assembly 12 such as that typically utilized in a fast food restaurant. The counter assembly 12 includes an exterior counter surface 13 which supports the apparatus 10 and which is dimensioned to be positioned adjacent to a cash register 14. Typically, the proprietor of a fast food restaurant might utilize the apparatus 10 to advertising special "combo" food dinners, or display the current menu to potential consumers. However, it should be understood that the apparatus 10 can also be employed at a table such as in a restaurant dining area. Moreover, and although the apparatus 10 is illustrated as a new and improved counter mat, the apparatus may additionally function as a general display device which is operable to display any printed indicia, and which may be mounted or supported on any rigid supporting surface.

Figure 3:
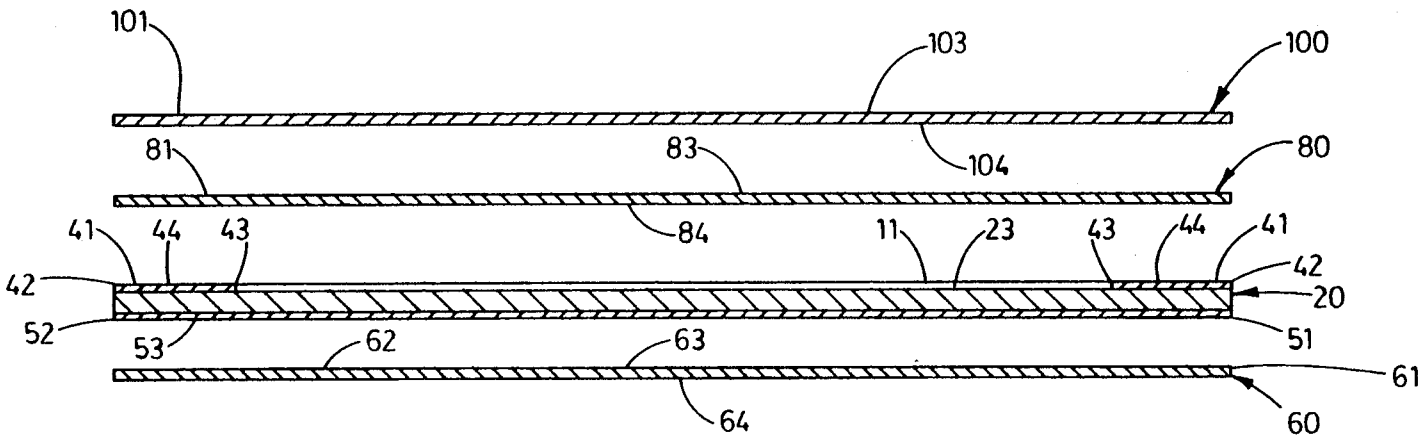
FIG. 3 is an exploded, transverse, vertical, sectional view of the first form of the apparatus of the subject invention, and which is taken from a position along line 2—2 of FIG. 1.

As best seen by reference to FIGS. 2, 3 and 4, the apparatus 10 includes a plurality of layered sheets, namely a base sheet 20, a release sheet 60, a substantially transparent cover sheet 80, and a protective film sheet 100. These sheets are individually described in more detail hereinafter.

The base sheet 20 includes a main body 21 having a predetermined shape and which is defined by a peripheral edge 22. As best illustrated in FIGS. 1 and 4, the main body 21 is substantially rectangular, but it should be understood that this main body can assume any desired shape. The main body further includes an outwardly facing surface 23 and an inwardly facing surface 24. The disclosed embodiment of the apparatus 10 includes a main body which is manufactured from a conventional 0.020 inch thick, white ABS material which can be purchased from numerous manufacturers, nationwide. Although the device of the subject invention may be manufactured from all manner of ABS, it has been determined that a printing grade ABS produces an optimum product. It should be understood, however, that other synthetic polymeric or natural materials may also be utilized to form the main body 21, such as, for example, styrene, vinyl, paper, polyester, foam stock or polycarbonate, to name but a few.

As best seen in FIGS. 1 and 4, the advertising indicia 11 are printed upon the outwardly facing surface 23 of the main body 21, and are illustrated in a form which would be employed in a typical fast food type restaurant. This particular printing style subdivides the main body 21 into a plurality of discrete advertising blocks 25. However, the printed advertising indicia may be disposed in a single advertising block, not shown. Each advertising block 25 may contain a promotional offer, such as a "combo" meal, which can be identified by printed symbols 26, such as a numeral or letter, for example. However, the advertising block 25 may also contain any other suitable information which promotes the particular goods or services. The printed advertising indicia 11 of each advertising block 25 may include one or several non-printed zones 27. Each non-printed zone has a predetermined shape which is defined by a portion of the peripheral edge 28 of the advertising block. The non-printed zones 27 are an integral feature of the apparatus 10, and are operable to define predetermined locations which support conformably shaped and removably interchangeable indicia 30.

The removable indicia 30 of the present invention each include a main body 31 having a predetermined shape and which is defined by the individual respective peripheral edges 32. Like the base sheet 20, the main body 31 may be manufactured from printing grade ABS or any other synthetic polymeric or natural materials such as, for example, styrene, vinyl, paper, or polycarbonate. The shape of the individual indicia 30 is typically conformably dimensioned to mate with each of the non-printed zones 27. When appropriately placed, the individual indicia 30 creates the illusion that each of the indicia are an integral feature of the printed advertising 11. The indicia 30 further includes an outwardly facing surface 33 and an inwardly facing surface 34. The inwardly facing surface 34 may have a removable adhesive deposited thereon, such as, for example, the water-base adhesive KIWO®, which permits the main body 31 to be adhesively positioned within, or in covering relation relative to, a respective non-printed zone 27. KIWO® is a registered trademark of Kiwo, Inc. of Seabrook, TX.

Typically, the outwardly facing surface 33 is printed with relevant product or service information 35 which pictorially relates or otherwise graphically cooperates with the printed advertising 11. For example, and as illustrated in FIGS. 1 and 4, the printed advertising 11 includes four advertising blocks 25, each displaying the individual "combo" meal of a particular hypothetical franchisee. Each advertising block 25 includes a non-printed zone 27. The individual "combo" meals are identified by a suitable symbol 26. Each non-printed zone 27 supports a respective removable indicia 30 which has printed thereon individual "combo" meal information 35, such as pricing information. Therefore, the apparatus 10 permits a consumer to readily identify a suitable "combo" meal before placing an order at the restaurant counter assembly 12. However, the apparatus 10 is further operable to selectively display removably interchangeable indicia 30 which permits the franchisee to modify relevant product and service information regarding such "combo" meals, such as the aforementioned prices. This feature of the device 10 obviates the purchase of an entire new display apparatus when product or service information changes. In this regard, the apparatus 10 is operable to be modified as described, however, the modification is not perceived by the consumer. This design feature of the apparatus 10 provides a flexible and cost effective means of advertising which can be readily modified by the removably interchangeable indicia 30, and which is additionally "environmentally friendly" in the sense that the advertising display apparatus 10 can continue to be used when relevant product and service information changes.

The advertising indicia 11, and the product or service information 35 may be printed upon the respective surfaces of the base sheet 20, and the main body 31 of the removable indicia 30 by any one of a number of conventional printing methods. As should be understood, these printing methods include, for example, screen printing, flexographic printing; offset lithography; or offset printing. However, a four color process offset printing method is preferred because of the photographic-like quality which can be produced when utilizing printing grade ABS and because the soft synthetic rubber surface of the blanket utilized in a conventional offset printing press creates a clearer impression on a wide variety of materials which may have both rough and smooth textures. A conventional offset ink may also be used, in the printing process, such as a GXUV ink which is commercially produced by The Sun Chemical Company of Tampa, FL.

As best understood by a study of FIG. 3, the outwardly facing surface 23 of the base sheet 20 has deposited thereon, in a predetermined pattern, a zone of adhesive 41 which is defined by an outer peripheral edge 42, an inner peripheral edge 43, and which has a predetermined thickness dimension 44. As illustrated, the zone of adhesive 41 is substantially continuous and is disposed substantially along the peripheral edge 22 of the base sheet. However, it is anticipated that the zone of adhesive 41 may also be discontinuous, and deposited in discrete locations upon the base sheet 20. A water-based pressure sensitive adhesive such as KIWO® may be used to form the zone 41, however, other adhesives may also be utilized, such as, for example, transfer adhesives, or pressure sensitive, solvent based adhesives.

The zone of adhesive 41, is applied selectively to the outwardly facing surface 23 by conventional screen printing methods which utilize a screen mesh to lay down the adhesive upon the base sheet. The preferred screen mesh is 230 monofilament polyester which typically would produce a zone of adhesive having a thickness of approximately 1.2 mils 44. However, the zone of adhesive 41 may also be selectively applied by utilizing a range of screen mesh types such as, for example, a screen mesh of 390 monofilament polyester which would produce a zone of adhesive having a thickness of approximately 0.2 mils, to a 76T screen mesh which would produce a zone of adhesive having a thickness of approximately 4 mils.

As best seen in FIG. 3, the inwardly facing surface 24 of the base sheet 20 has a layer of non-skid material 51 deposited thereon. The non-skid material has a predetermined shape which is defined by a peripheral edge 52 and a thickness dimension 53, and which is operable to releasably fix the position of the apparatus 10 on the counter surface 13. Suitable non-skid materials include, but are not limited to, a screenable removable adhesive such as KIWO®, a transfer type adhesive, all manner of adhesive tapes and foam laminates, to name but a few. However, and if the apparatus 10 is mounted on a suitable vertical supporting surface, such as a wall or a pillar, the layer of non-skid material would be replaced by a removable pressure sensitive adhesive composition. The layer of non-skid material 51 of the preferred embodiment is applied to the inwardly facing surface of the base sheet 20 by the aforementioned conventional screen printing methods.

The release sheet 60 includes a main body 61 having a predetermined shape which is defined by a peripheral edge 62. The release sheet 60 also has an outwardly facing surface 63 which releasably engages the layer of non-skid material 51, and an inwardly facing surface 64. As should be understood, the release sheet 60 is merely operable to prevent the layer of non-skid material 51 from adhesively engaging foreign particles prior to use and adjoining devices or surfaces when it is shipped to consumers. Accordingly, the outwardly facing surface 63 has a release coating which facilitates this separation. These release coatings are well known in the art.

As best understood by a study of FIG. 4, the substantially transparent cover sheet 80 includes a main body 81 having a predetermined shape and which is defined by a peripheral edge 82. The main body 81 includes an outwardly facing surface 83 and an inwardly facing surface 84. The transparent cover sheet 80 is conformably dimensioned to mate with the base sheet 20, and is operable to selectively locate and substantially seal the removably interchangeable indicia 30 within the apparatus 10 for view by a consumer. The cover sheet 80 may be made of any pliant substantially transparent material, such as, for example, LEXAN ® HP92 which is a hard coated polycarbonate resin sheet which is manufactured by the General Electric Company. LEXAN ® is a registered trademark of the General Electric Company of Pittsfield, Mass. Although not illustrated in the drawings, it is anticipated that the outwardly facing surface 83 or the inwardly facing surface 84 may be printed or otherwise decorated to pictorially relate or otherwise graphically cooperate with the printed advertising 11 and the removable indicia 30. In these instances, that portion of the cover sheet which is printed may become translucent or completely opaque depending upon the printing technique employed. Further, and although the zone of adhesive is deposited on the outwardly facing surface 23 of the base sheet, it is anticipated that the zone of adhesive 41 may be alternatively deposited upon the inwardly facing surface 84 of the transparent cover sheet 80.

The protective film sheet 100 includes a main body 101 having a predetermined shape which is defined by a peripheral edge 102. Main body 101 includes an opposite, outwardly facing surface 103 and an inwardly facing surface 104. As should be understood, the protective film sheet 100 is provided to substantially protect the outwardly facing surface 83 of the cover sheet 80 during shipment, or before use. Accordingly, the protective film may be made of any suitable material which is operable to removably engage the outwardly facing surface 83 of the cover sheet 80.

SECOND FORM

The apparatus or device of the second form of the present invention is generally indicated by the numeral 110, and is best illustrated by reference to FIG. 5. As shown therein, the apparatus includes a base sheet 120; the release sheet 60; the substantially transparent cover sheet 80; the protective film sheet 100 and a removably interchangeable printed sheet 130. As should be understood, the release sheet, cover sheet, and the protective film sheet are substantially identical to the corresponding structures of the first form of the present invention. Therefore, for purposes of brevity, these structures are not described in further detail herein.

Figure 5:
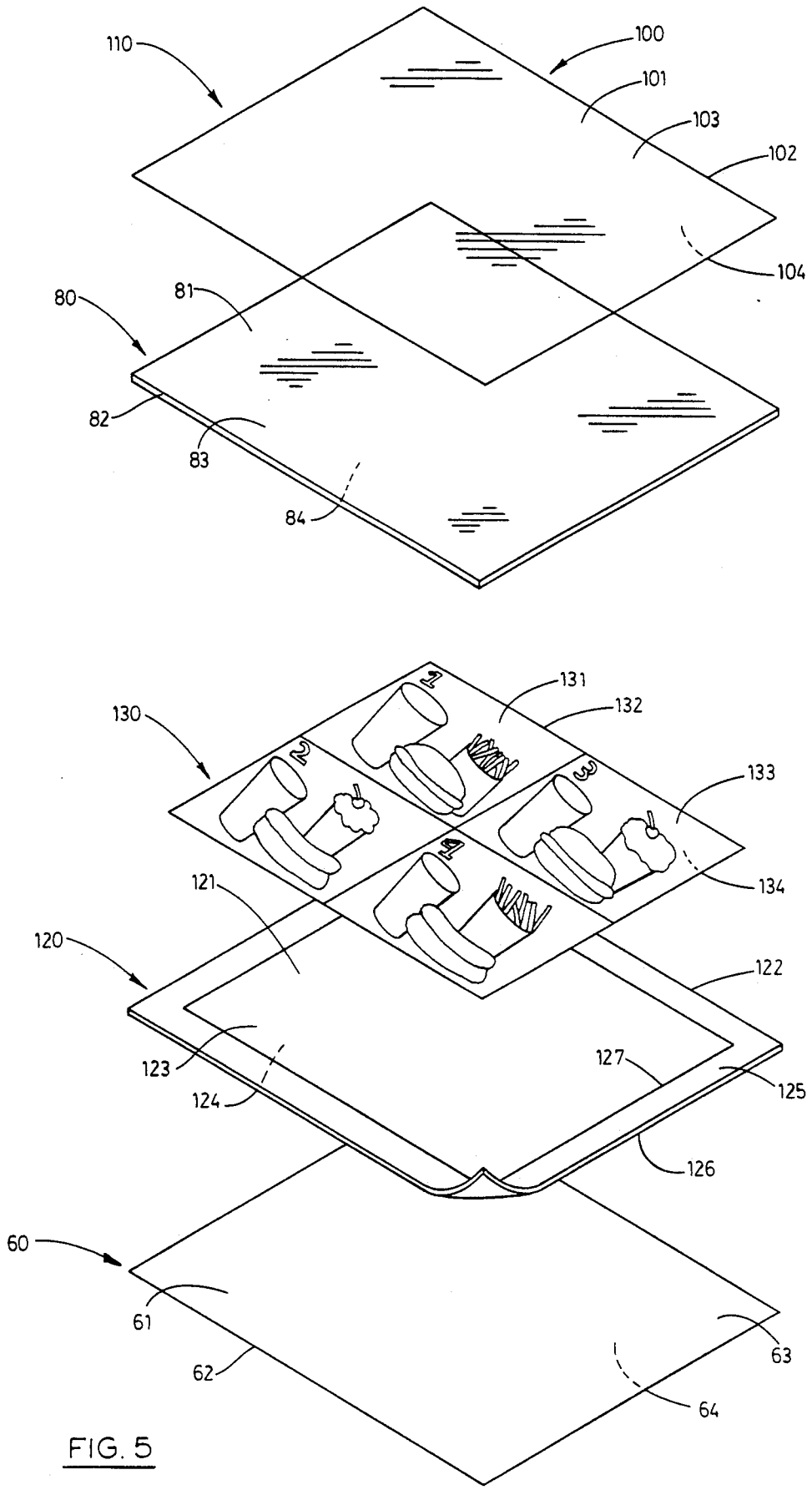
FIG. 5 is a perspective, exploded view of the second form of the apparatus of the subject invention.

Referring more particularly to FIG. 5, the device 110 includes a base sheet 120 which is somewhat different from the base sheet 20 which was described earlier with respect to the first form of the present invention. In this regard, the base sheet 120 includes a main body 121 having a predetermined shape and which is defined by a peripheral edge 122. As illustrated in FIG. 5, the main body 121 is substantially rectangular, but it should be understood that the main body can assume any desired shape. The main body further includes an outwardly facing surface 123 and an opposite inwardly facing surface 124. The main body 121 is manufactured from substantially the same materials as the main body 21 of the first form, i.e. from a conventional .020 inch thick, white, ABS material, although, and as previously discussed, other synthetic polymeric or natural materials may also be utilized. Examples of these materials include styrene, vinyl, paper, polyester, foam stock or polycarbonate, to name but a few.

As best seen by a close study of FIG. 5, it should be recognized that the outwardly facing surface 123 does not have printed matter deposited thereon as is the case with respect to the outwardly facing surface 23 of the first form. Rather, the second form includes a removably interchangeable printed sheet 130, and which will be described in greater detail, hereinafter.

The outwardly facing surface 123 of the base sheet 120 has deposited thereon, in a predetermined pattern, a zone of adhesive 125 which is defined by an outer peripheral edge 126 and an inner peripheral edge 127. This zone of adhesive 125 is substantially identical to the zone of adhesive 41 of the first form, and is further applied to the outwardly facing surface 123 in a substantially identical fashion as was previously described. Further, the inwardly facing 124 has deposited thereon a layer of non-skid material which is substantially identical to the layer of non-skid material 51 of the first form, and which is applied to the inwardly facing surface 123 in a substantially identical manner. This non-skid material is operable to releasably fix the position of the apparatus 110 on the counter surface 13.

As discussed above, the apparatus 110 includes a removably interchangeable printed sheet 130 having a main body 131. The main body 131 has a predetermined shape which is defined by a peripheral edge 132, and which is conformably dimensioned to be located on the base sheet 120 and in a position defined by of the inner peripheral edge 127 of the zone of adhesive 125. Further, the main body 131 includes an outwardly facing surface 133 and an inwardly facing surface 134. The outwardly facing surface 133 is typically printed with printed advertising indicia or relevant product or service information 11. As illustrated in FIG. 5, the printed advertising indicia 11 includes four advertising blocks each displaying the individual "combo" meal of a particular hypothetical franchisee. Therefore, and like the apparatus 10 of the first form, the apparatus 110 of the second form permits a customer to readily identify a suitable "combo" meal before placing an order at the restaurant counter assembly 12. However, and when promotional advertising campaigns end or are altered in some manner, the now obsolete printed sheet 130 may be removed from the apparatus 110 and replaced with a revised or current printed sheet 130. This design feature of the apparatus 110 provides a flexible and cost effective means of advertising which can be readily modified by the removably interchangeable printed sheet 130, and which is additionally "environmentally friendly" in the sense that the advertising display apparatus 110 can continue to be used when relevant product and service information changes. The printed sheet is typically manufactured from paper, however, other synthetic materials could be substituted for same.

Advertising indicia 110, may be printed upon the outwardly facing surface 133 of the removably interchangeable sheet 130 by any one of a number of conventional printing methods. However, and as previously described, a four color process offset printing method is preferred because of the photographic-like quality which can be produced.

OPERATION

The operation of the described embodiments of the present invention are believed to be readily apparent and are briefly summarized at this point.

FIRST FORM

As best seen by reference to FIGS. 1 and 4, the apparatus 10 for selectively displaying removably interchangeable indicia includes a base sheet 20 which includes an outwardly facing display surface 23 and an opposite inwardly facing display surface 24. The outwardly facing display surface has printed thereon advertising indicia 11; this surface may also support the zone of adhesive 41 which is deposited adjacent to the peripheral edge 22 thereof. The outwardly facing display surface is additionally operable to support removably interchangeable indicia 30 in predetermined locations which are defined by the non-printed zones 27. The inwardly facing surface 24 is operable for surmounted engagement with an adjoining supporting surface, such as a counter. The apparatus 10 further includes a pliant and substantially transparent cover sheet 80. During use, the transparent cover sheet 80 is operable to selectively locate and substantially seal the removably interchangeable indicia 30 within the apparatus 10 when the cover sheet adhesively engages the zone of adhesive 41 which thereby protects the printed indicia 11 and removable indicia 30 from debris and other environmental conditions and contaminants. The transparent cover sheet 80 further is operable to be separated in spaced relation from the base sheet which permits the placement of the removable indicia 30 on the outwardly facing surface 23 of the base sheet 20. Following placement of the indicia, the transparent sheet 80 is pressed into adhesive engagement with the zone of adhesive 41 which locates and substantially seals the indicia on the base sheet 20.

SECOND FORM

As best seen by reference to FIG. 5, the apparatus 110 includes a base sheet 120 having an outwardly facing surface 123 and an opposite inwardly facing surface 124. The outwardly facing 123 supports the zone of adhesive 125 which is deposited adjacent to the peripheral edge 122 thereof. The outwardly facing surface is additionally operable to support the removably interchangeable printed sheet 130 in a predetermined location defined by the inner peripheral edge 127. During use, the cover sheet 80 of the second form is operable to selectively locate and substantially seal the removably interchangeable printed sheet 130 within the apparatus 110 when the cover sheet adhesively engages the zone of adhesive 125 which thereby protects the printed indicia 11 from debris and other environmental conditions and contaminants. As in the first form, the transparent cover sheet 80 of the second form further is operable to be separated in spaced relation from the base sheet 120 which permits the placement of the removable printed sheet 130 on the outwardly facing surface 123 of the base sheet 120. Following placement of the removable printed sheet 130, the transparent cover sheet 80 is pressed into adhesive engagement with the zone of adhesive 125 which locates and substantially seals the printed sheet on the base sheet 120.

Therefore, the two forms 10 and 110 of the subject invention provide an improved means for displaying advertising indicia in a cost effective manner, can be manufactured and purchased at nominal cost, are both lightweight and multifunctional in design such that they may be surmounted on a counter of a commercial establishment or other suitable supporting surface, and are further designed in a fashion whereby the assorted problems associated with many of the prior art devices which are designed for substantially identical purposes are reduced to an absolute minimum.

Although the present invention has been shown herein and described in what is conceived to be the most practical and preferred embodiments, it is recognized that departures may be made therefrom within the scope of the invention which is not to be limited to the illustrative details disclosed.

Having thus described and illustrated my invention what I claim as new and desired to secure by Letters Patent is:

1. A counter display for selectively displaying removably interchangeable advertising indicia, the counter mat comprising:

a uniformly planar base sheet having a predetermined shape which is defined by a peripheral edge, and wherein the base sheet includes an outwardly facing display surface, and an opposite, inwardly facing surface, the outwardly facing display surface supporting printed advertising indicia thereon, and wherein the printed advertising indicia defines discrete zones each having a predetermined shape, and wherein the inwardly facing surface has a zone of adhesive deposited thereon which is operable to adhesively and releasably engage a supporting counter surface;

a zone of releasable adhesive deposited in a predetermined pattern along the peripheral edge of the base sheet and upon the outwardly facing display surface;

a plurality of removably advertising indicia, each having a main body which has a predetermined shape which is matingly and conformly dimensioned to be located on the base sheet and within the discrete zones, and which graphically cooperates with the printed advertising indicia; and a removably transparent sheet borne by the base sheet, and which is operable to engage the advertising indicia thereby removably fixing the advertising indicia within each of the discrete zones, and further seals the advertising indicia internally of countermat thereby making the advertising indicia inaccessible except by removal of transparent sheet.

2. An advertising display assembly having component parts capable of being assembled at a remote location to form a sealed counter mat which selectively receives removably interchangeable advertising indicia, the assembly comprising:

a substantially uniformly planar base sheet having a predetermined shape which is defined by a peripheral edge, and wherein the base sheet includes an outwardly facing display service, and an opposite inwardly facing support surface;

a zone of releasable adhesive deposited in a predetermined pattern along the peripheral edge of the base sheet and upon the outwardly facing display surface;

a removably interchangeable printed sheet having a predetermined shape which is defined by a peripheral edge, and wherein the printed sheet includes an outwardly facing display surface, and an opposite, inwardly facing surface, the outwardly facing display surface supporting printed advertising indicia thereon, the printed advertising indicia defining discrete zones each having a predetermined shape, and wherein the printed sheet is conformably dimensioned to be located on the outwardly facing surface of the base sheet;

a plurality of removably advertising indicia, each having a main body which has a predetermined shape which is matingly and conformably dimensioned to be located within a respective discrete zone, and which graphically cooperates with the printed advertising indicia; and a removably transparent sheet borne by the base sheet and engageable with zone of adhesive, and which is operably to engage the advertising indicia thereby removably fixing the advertising indicia within each of the discrete zones.

3. A counter display mat comprising:

a uniformly planar base sheet having a predetermined shape which is defined by a peripheral edge, and wherein the base sheet includes an outwardly facing surface and an opposite inwardly facing surface;

a printed sheet having a main body which defines a predetermined shape which is conformably dimensioned to be located upon the base sheet interiorly of the peripheral edge, and wherein the printed sheet includes an outwardly facing surface, and an opposite inwardly facing surface, the outwardly facing surface having printed advertising indicia deposited thereon, and wherein the printed advertising indicia defines discrete substantially planar zones;

a zone of releasable adhesive deposited in a predetermined pattern upon the outwardly facing surface of the base sheet and along the peripheral edge thereof;

a plurality of removably interchangeable advertising indicia each having a main body which is defined by a respective predetermined shape which is matingly and conformably dimensioned to be located within a discrete zone, and which graphically cooperates with the printed advertising indicia; and a removably transparent sheet borne by the base sheet and adhesively engaged by the zone of adhesive, the transparent sheet operable to engage the advertising indicia thereby removably fixing the printed sheet and the removably advertising indicia upon the base sheet.

* * * * *